United States Patent [19]

Chase

[11] Patent Number: 4,497,590

[45] Date of Patent: Feb. 5, 1985

[54] TUNNEL LINING

[75] Inventor: Arthur P. Chase, Potomac, Md.

[73] Assignee: CRS Group, Inc., Houston, Tex.

[21] Appl. No.: 356,133

[22] Filed: Mar. 8, 1982

[51] Int. Cl.[3] ..... E21D 11/00

[52] U.S. Cl. ..... 405/152; 405/153

[58] Field of Search ..... 405/150–153, 405/146; 52/245, 396, 584, 580

[56] References Cited

U.S. PATENT DOCUMENTS

| | | | |
|---|---|---|---|
| 830,345 | 9/1906 | Mattson | 52/245 |
| 935,376 | 9/1909 | Lennon | 405/153 |
| 1,004,288 | 9/1911 | McAlpine | 405/151 |
| 1,055,074 | 3/1913 | Pease | 405/151 |
| 1,381,119 | 6/1921 | Hastings | 405/153 X |
| 1,953,920 | 4/1934 | Blackman | 405/151 X |
| 2,096,850 | 10/1937 | Forsberg | 405/150 |
| 2,435,079 | 1/1948 | Hotchkin | 52/584 |
| 3,415,063 | 12/1968 | Akita et al. | 405/153 |
| 4,281,495 | 8/1981 | Lee | 52/580 |

FOREIGN PATENT DOCUMENTS

| | | | |
|---|---|---|---|
| 553621 | 6/1932 | Fed. Rep. of Germany | 405/150 |

*Primary Examiner*—Cornelius J. Husar
*Assistant Examiner*—Nancy J. Stodola
*Attorney, Agent, or Firm*—Vinson & Elkins

[57] ABSTRACT

A prefabricated tunnel lining is disclosed comprised of a plurality of interconnected longitudinally abutting rings, each ring being comprised of a plurality of interconnected ring sections. The ring sections are each prefabricated of concrete with an internally cast steel reinforcement and have overlapping circumferential and longitudinal edges adapted to mate with corresponding edges of circumferentially adjacent sections in the same ring and longitudinally adjacent sections in longitudinally adjacent rings of the liner. Threaded fasteners extend at an angle through holes in the ring segments extending from the inside surfaces of each segment through an edge portion thereof, and communicating with a threaded insert cast into the corresponding mating edge of adjacent sections.

14 Claims, 7 Drawing Figures

TUNNEL LINING

This invention relates to improvements in tunnel linings and, more particularly, to an improved tunnel lining which may be formed of pre-fabricated reinforced concrete segments.

In the construction of underground tunnels used for rail, vehicular or pedestrian traffic, or for aqueducts, storm drains or the like, it is conventional practice first to bore or excavate the tunnel through subterranean strata and then to provide a water-tight lining about the entire periphery thereof. Such a lining serves multiple purposes. It reinforces the tunnel and walls against caveins, prevents the intrusion of water into, or loss of water from, the tunnel and provides a smooth bore facilitating the transport of liquids without undue pressure loss. In the case of a rail, vehicular or pedestrian traffic tunnel, the lining may be formed to provide a generally level transport surface.

Tunnel linings have been provided by a variety of prior art means. For example, concrete or gunite linings may be cast or formed in situ as, for example, described in U.S. Pat. No. 2,172,030. Pre-fabricated tunnel linings have also been known and used for many years. In their earliest form, pre-fabricated tunnel linings were customarily made of steel or cast iron arcuate segments which could be bolted together to form complete cylindrical tunnel linings. Radially disposed depending flanges with bolt openings therethrough on the individual segments permitted them to be bolted together to form the entire cylindrical structure.

A pre-fabricated tunnel lining system employing flexible lining segments is also disclosed in U.S. Pat. No. 2,841,297. In this system, the tunnel lining segments are constructed of a flexible material (preferably metal) so that each succeeding segment after the first one installed may be temporarily distorted and, in the distorted shape, may be passed through the installed segment to be placed ahead of it in a continuation of the installed portion of the lining.

Because of the high cost of material for pre-fabricated metal tunnel linings and the high cost of labor for tunnel linings consisting of concrete or gunite formed in situ, interest in recent years has centered on forming tunnel linings of pre-cast segments of reinforced concrete, which may be assembled within the tunnel bore to provide a unitary lining. A principal difficulty in adapting pre-cast concrete to this use has been in devising satisfactory means for fastening or connecting the individual segments to each other to form a unitary structure. See, for example, the fastening systems disclosed in U.S. Pat. Nos. 4,104,885 and 1,381,119. Additional examples of concrete tunnel linings, and fasteners therefor, are disclosed in a document entitled "Systems Study of Pre-Cast Concrete Tunnel Liners" dated January, 1975, prepared for the U.S. Department of Transportation by Bechtel, Inc.

The difficulty in providing suitable means for connecting individual pre-fabricated concrete tunnel lining segments together is accentuated because the concrete, which has very high compressive strength, has relatively low tensile strength. In general, the prior art systems have included either the use of a steel perimeter angle cast into each concrete segment, so that connecting bolts may be fastened to the steel perimeter angle, the use of steel faceplates anchored in the concrete segments for transmitting bolt forces, and "through bolt" systems, in which elongated bolts are passed through the bodies of the segments to tie the segments of the tunnel lining together. The "through bolt" system is generally most advantageous in that it avoids the necessity for casting steel plates or flanges into the concrete segments, but has the disadvantage that the "through bolts" must be relatively long, because they must pass through substantially the entire bodies of the thick lining segments or through relatively thick concrete flanges cast onto the segments.

It is accordingly the primary object of the present invention to provide an improved prefabricated tunnel lining composed of individual pre-cast segments of reinforced concrete.

Another object is to provide such an improved prefabricated lining which employs an interlocking edge design for the individual lining segments and an improved threaded fastener system for joining the individual segments into a unitary structure.

It is a further object to provide such a system in which the threaded fastener system for connecting the individual segments comprising the assembled lining may accommodate slight misalignment between segments in either the circumferential or longitudinal directions without placing undue stresses on the concrete structure of the segments.

A still further object is to provide a tunnel lining system in which the assembled precast lining segments will provide a generally flat bottom surface sloping slightly toward an intermediate trough area inside the tunnel lining which may be used for vehicular or pedestrian traffic.

These and other objects and advantages of the lining of the present invention may be understood from the following disclosure and specification of the preferred embodiment when read in conjunction with the accompanying drawings in which like numerals indicate like parts and in which.

Figure 1:
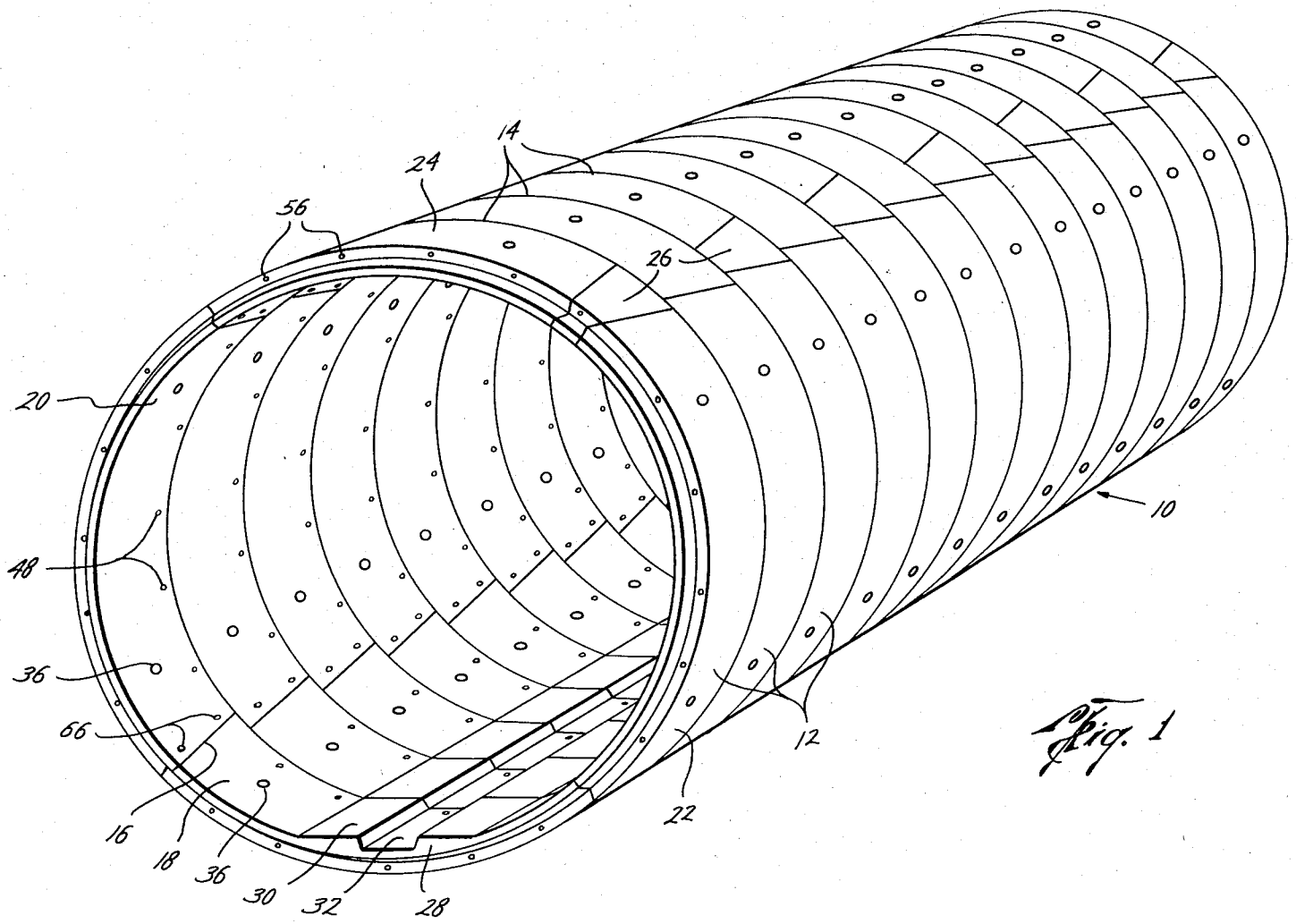
FIG. 1 is an external perspective view illustrating a section of cylindrical tunnel lining constructed in accordance with the present invention.

Referring now to FIG. 1, there is shown a cylindrical annular tunnel lining structure 10 comprising thirteen segmented rings 12 fastened to each other in longitudinally abutting relationship along twelve circumferential joints 14. It will be appreciated that, in actual use, the tunnel lining 10 will be assembled inside of the generally cylindrical bore of a tunnel excavated under the earth's surface and will be comprised of any desired number of the segmented rings 12, depending upon the length of the tunnel.

Each of the segmented rings 12 is comprised of a plurality of individual arcuate annular reinforced concrete segments fastened to each other in circumferentially abutting relationship along a plurality of generally longitudinally extending joints 16. In the preferred embodiment, as illustrated, each ring 12 is formed of five individual arcuate segments including a base segment 18, left and right sidewall segments 20 and 22, respectively, a roof segment 24, and a keystone segment 26. As shown in FIG. 1, the keystone segment 26 alternates in placement between the roof segment 24 and right sidewall segment 22, and the roof segment 24 and left sidewall segment 20 in successive rings 12. The base segment 18 is formed with a thickened central portion 28 so configured to provide two generally flat surfaces 30 inside the tunnel lining, which may provide a surface for rail, vehicular or pedestrian traffic, and which slope toward an intermediate trough area 32 recessed below the surfaces 30, to provide for drainage of water that may leak into the tunnel lining from the surrounding earth, or be otherwise introduced into the tunnel.

Figure 6:
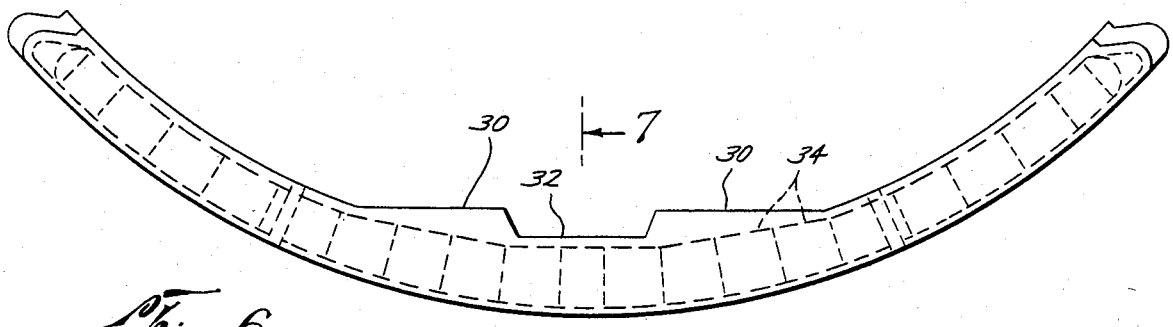
FIG. 6 is an elevational view of the base member segment of one of the tunnel rings, illustrating in phantom lines details of the steel reinforcing structure; and, FIG. 7 is an elevational view and partly in section taken on along line 7—7 of FIG. 6 illustrating details of the steel reinforcing structure.
Figure 7:
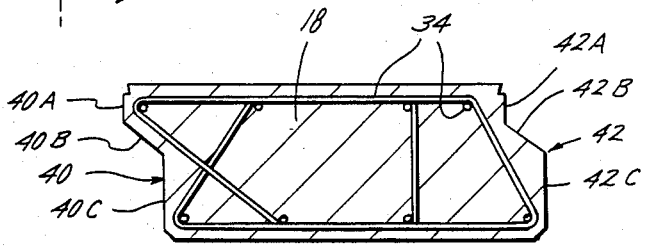

Each of the rings is preferably formed of precast concrete and, as illustrated in FIGS. 6 and 7, each segment is reinforced with steel rods or bars 34 connected to form a reinforcing structure approximating the shape of the ring segment and cast interiorly of the concrete body of the segment. Although FIGS. 6 and 7 illustrate a reinforcing structure only for the ring base segment 18, it will be appreciated that similar reinforcement is provided interiorly of each of the ring segments.

Figure 2:
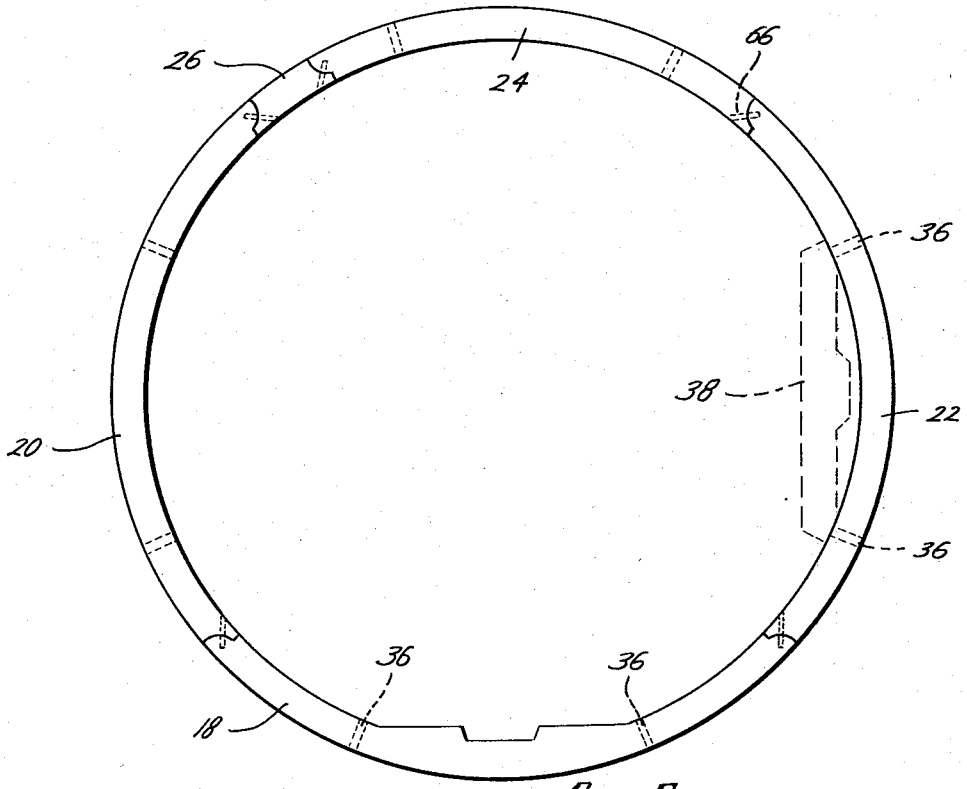
FIG. 2 is an end elevational view of the tunnel lining of FIG. 1.
Figure 3:
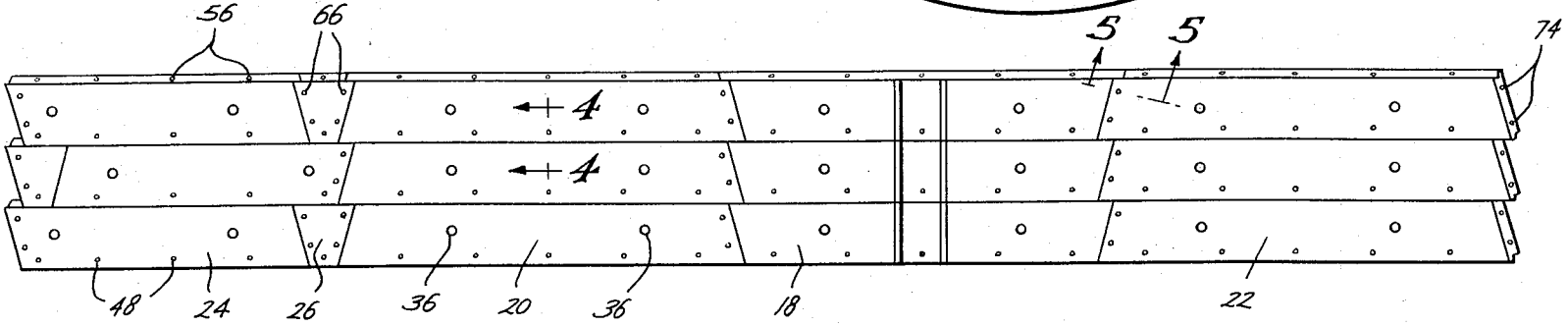
FIG. 3 is a plan view illustrating three of the composite rings of the lining of FIG. 1 laid out into a horizontal plane to illustrate details of the construction.

With the exception of the keystone segment 26, each of the arcuate ring segments are provided with two circular openings 36, which extend through the entire annular thickness of the segments from the inner to the outer surfaces thereof and provide means for attaching a temporary handling bridge 38, illustrated in phantom line in FIG. 2 which is used in construction of the tunnel lining. After assembly of the lining segments and removal of the temporary handling bridge 38, the openings 36 provide access between the interior of the tunnel lining and the annular space between the wall of the tunnel bore and the outside surface of the tunnel lining. Grout or cement may be pumped through openings 36 to fill the annular space around the lining and to close the openings 36.

The assembled tunnel lining 10 presents an essentially smooth internal bore, without depending flanges or recesses in the ring segments for attaching fastening bolts. This improved configuration is made possible by the particular interlocking edge design used for the individual arcuate ring segments, as shown most clearly in FIGS. 4 through 7.

Each of the individual annular arcuate segments comprising the rings 12 of the tunnel lining has first and second circumferential edges for defining the circumferential joints 14 between adjacent rings and first and second generally longitudinal edges for defining the generally longitudinal joints 16 between circumferentially adjacent segments in each individual ring. These circumferential and longitudinal edges are of interfitting configurations which, when assembled and fastened to each other provide for structural support between adjacent ring segments, and thus greatly increase the overall strength of the assembled lining.

The first and second circumferential edges on each segment are provided with generally mating annular stepped configurations comprising three intersecting stepped edge surfaces, with the first circumferential edge on each arcuate segment in one ring being configured to mate with the second circumferential edge of the corresponding segment of the next longitudinally adjacent ring.

The first and second longitudinal edges on each ring segment have generally annular arcuate configurations, whereby the first longitudinal edge on each ring segment will mate with the second longitudinal edge on the next circumferentially adjacent ring segment, to provide a generally annular arcuate configuration for the longitudinal joints between circumferentially adjacent ring segments. As explained in greater detail below, this annular arcuate edge configuration provides a particularly advantageous structure for accommodating limited noncircular alignment of the ring segments.

Figure 4:
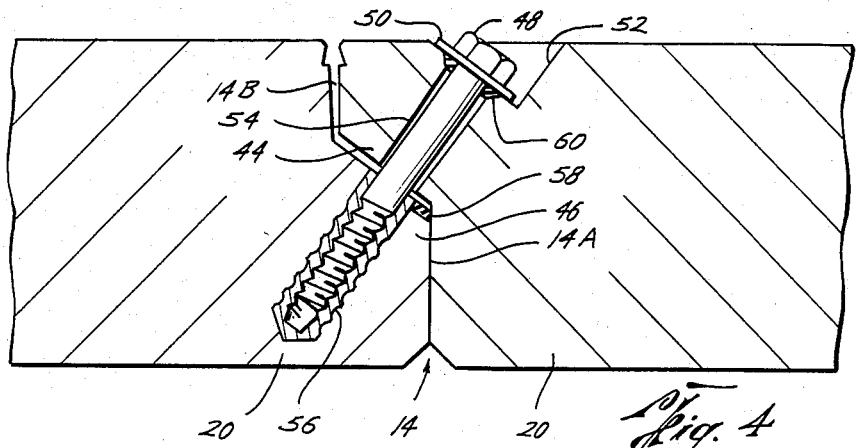
FIG. 4 is an enlarged detail view, in elevation and partly in section, taken along line 4—4 of FIG. 3 and illustrating the structure of a joint between longitudinally adjacent rings of the lining as well as the threaded fastener system for joining the longitudinally adjacent ring segments.

Referring to FIG. 7, the first and second circumferential edges on the base ring segment 18 are denominated 40 and 42, respectively. Each is comprised of three intersecting planes, 40A, 40B and 40C, and 42A, 42B and 42C. This stepped edge design provides a stepped mating configuration for each of the circumferential joints 14 between longitudinally adjacent ring segments 12. The configuration of the assembled circumferential joints 14 is illustrated most clearly in FIG. 4. There the first circumferential edge 44 of a wall segment 20 of one ring 12 is shown in abutted relationship to the second circumferential edge 46 of a wall segment 20 in the next longitudinally adjacent segmented ring 12. As shown in FIG. 4, while the first and second circumferential edges of the adjacent ring wall segments 20 are in generally overlapping stepped and mated relationship, the actual configuration of the stepped edges, and the dimensioning of the edges, is such that the adjacent segments 20 are in actual physical abutment for only a portion of the annular thickness of segments 20 and the annular joint 14, the abutting portion of the joint being indicated by the numeral 14A in FIG. 4, and are in spaced-apart relationship for a portion of the annular thickness of the circumferential joint, the spaced-apart relationship being designated by the numeral 14B in FIG. 4. The spaced-apart portion 14B of the joint provides a groove between longitudinally adjacent rings 12 into which a flexible sealant or grout may be placed to assist in sealing between the rings. The groove also permits limited misalignment between rings, to accommodate manufacturing and assembly tolerances.

The longitudinally adjacent rings 12 of the tunnel lining are held in abutting relationship by means of a plurality of threaded fasteners received through a corresponding number of openings cast in the individual arcuate ring segments and extending from the inner surfaces of the ring segments through a stepped portion of the circumferential edges of the segments of one ring and threadedly engaged with thread receiving means in the mating portion of the circumferential edges of longitudinally adjacent segments of the abutting ring. This configuration is illustrated in FIG. 4, showing a threaded bolt 48 and washer 50 received within a recess 52 cast adjacent the first circumferential edge of the arcuate segment 20. The angled recess 52 is sized to accommodate the head of bolt 48 and washer 50 and opens into a tapered opening 54 which extends from the recess 52 to the face of the inclined portion of the first longitudinal edge 44 of the segment 20. The bolt 48 extends through the tapered opening 54 and is threadedly engaged with a thread receiving means comprising a plastic threaded insert 56 cast into the mating portion of the second circumferential edge 46 of the longitudinally adjacent ring segment 20. A resilient seal member 58 is disposed between the mating edge surfaces adjacent to the bolt 48. Resilient seal material 60 is disposed between the washer 50 and the surface of the bolt head recess 52 and upper portion of the tapered bolt hole opening 54 to provide a fluid-tight seal.

The tapered configuration for the tapered bolt hole opening 54 accommodates limited angular movement between the adjacent ring segments 20 with the bolt 48 in place, without placing undue tensile or bending stress on the ring segments 20.

Although described only in connection with a single circumferential joint 14 between the longitudinally adjacent segments 20 of two rings 12, it will be apparent that similar mating stepped annular joints will be provided between each of the arcuate ring segments comprising each of the individual rings 12, and that a plurality of the bolts 48 will be provided for joining each of the arcuate segments of each ring to the next longitudinally adjacent ring segments.

It is not possible to assemble the arcuate segments of each ring into a perfect circular configuration. Therefore it is highly desirable to provide a longitudinal edge configuration for the ring segments which accommodates limited non-circularness or angular misalignment between the ring segments while preserving maximum contact areas between circumferentially adjacent ring segments for structural strength. This has been accomplished in the present invention by providing mating concave and convex longitudinal edges on circumferentially adjacent arcuate ring segments, to provide a ball-and-socket type of longitudinal joint between the segments to accommodate limited movement or misalignment between segments while preserving maximum contact areas for load bearing purposes.

Figure 5:
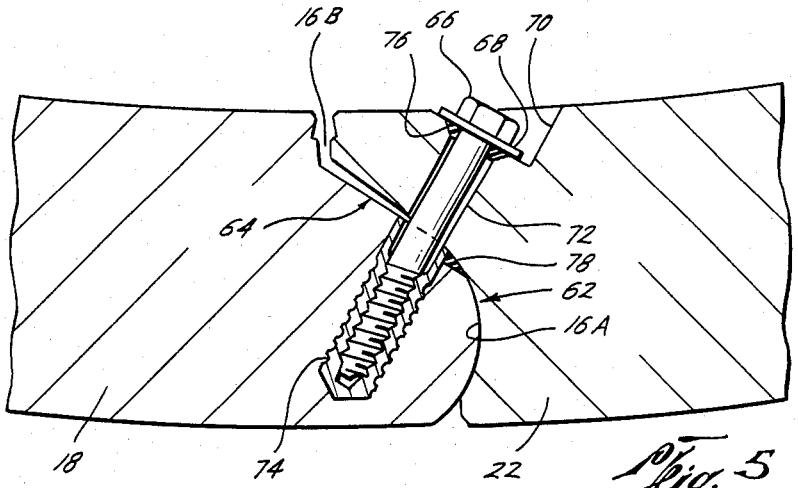
FIG. 5 is an enlarged detail view, in elevation and partly in section, taken along line 5—5 of FIG. 3 and illustrating the structure of a joint between circumferentially adjacent arcuate segments in the same tunnel ring and details of the threaded fastener system for joining the circumferentially adjacent ring segments.

This preferred configuration of the generally longitudinal joints and longitudinal edges of the individual arcuate ring segments is illustrated most clearly in FIG. 5. There are illustrated in mating relationship a first longitudinal edge 62 on a ring sidewall segment 22 and the adjacent second longitudinal edge 64 on the circumferentially adjacent bottom ring segment 18. Both such longitudinal edges are generally arcuate throughout most of their annular thickness, with the second longitudinal edge portion on bottom segment 18 being generally convex and the first longitudinal edge portion on wall segment 22 being generally concave. The radii of curvature of the convex and concave edges are approximately equal for only a portion of the annular thickness of the ring segments, as indicated at 16A, so that the adjacent longitudinal edges of circumferentially adjacent arcuate segments 18 and 22 are in direct abutting relationship for only a portion of the annular thickness of the longitudinal joint 16 and are in spaced-apart relationship for another portion of the annular thickness of longitudinal joint 16 indicated at 16B. This structure permits limited non-circular alignment to be accommodated between circumferentially adjacent ring segments while still providing a substantial area of abutting contact area for transmission of loading forces. The spaced-apart portion 16B of the longitudinal joint 16 also provides a longitudinal groove within which a compressible sealant may be placed to assist in sealing between the adjacent ring segments. Since the compressible sealant will be placed in the longitudinal grooves 16B and circumferential grooves 14B after the tunnel lining is assembled, it is, of course, preferable that the grout-receiving grooves be accessible from the interior of the assembled lining.

The circumferentially adjacent arcuate ring segments of each of the individual rings 12 are held in abutting relationship by means of a plurality of threaded fasteners received through a corresponding number of openings cast in said segments and extending from the inner surface of the ring segments thereof through one longitudinal edge thereof and threadedly engaged with thread receiving means in the mating portion of the longitudinal edge of the circumferentially adjacent ring segment. This configuration, which is essentially the same as that used between longitudinally adjacent ring segments and illustrated and described in connection with FIG. 4 above, is illustrated for the circumferentially adjacent ring segments in FIG. 5. A bolt 66 and washer 68 are received in bolt head recess 70 and tapered bolt hole opening 72 in ring segment 22 and threadedly engaged with a plastic threaded insert 74, integrally cast with the mating longitudinal edge of the adjacent bottom ring segment 18. Again, the tapered configuration of the tapered bolt hole opening 72 permits limited misalignment between the bottom segment 18 and sidewall segment 22, without placing undue bending or tensile stresses on the concrete material of the segments. A flexible seal member 76 seals between the bolt 66 and washer 68 and the wall of the bolt head recess 70 and tapered bolt hole 72 and a second flexible seal member 78 disposed between the overlapping concave and convex longitudinal edges of the segments 18 and 22 adjacent to the bolt 66 provides a fluid seal between the segments 18 and 22.

Although described only in connection with a single longitudinal joint between the circumferentially adjacent segments 18 and 22 of one ring 12, it will be apparent that similar annular arcuate joints, although in some cases with the directions of concavity and convexity reversed, will be provided between each of the arcuate ring segments comprising each of the individual rings 12, and that a plurality of the bolts 66 will be provided for joining each of the arcuate segments of each ring to the next circumferentially adjacent segments.

The foregoing disclosure constitutes a description of the preferred embodiment of the invention, and various changes in the size, shape and materials of construction, as well as other details of the illustrated embodiment, may be made within the scope of the appended claims without departing from the spirit of the invention.

What is claimed is:

1. A prefabricated cylindrical tunnel lining comprising a plurality of annular reinforced concrete rings fastened to each other in longitudinally abutting relationship along a plurality of abutting circumferential joints;

each of said rings comprising a plurality of reinforced concrete arcuate ring segments fastened to each other in circumferentially abutting relationship along a plurality of generally longitudinal joints;

each of said arcuate ring segments having first and second circumferential edges for defining said circumferential joints and first and second generally longitudinal edges for defining said generally longitudinal joints;

said first and second circumferential edges having generally mating stepped annular configurations comprising at least three intersecting stepped edge surfaces, with the circumferential stepped edge on each arcuate ring segment in one ring being configured to mate with the stepped edge of the adjacent arcuate segments of the next longitudinally adjacent ring to provide a generally mating stepped annular configuration for said plurality of circumferential joints;

means for accommodating limited non-circular alignment between said circumferentially abutting ring segments while preserving maximum contact areas between said circumferentially abutting ring segments for structural strength, said means comprising said first and second longitudinal edges having generally mating annular arcuate configurations with the longitudinal arcuate edge on each ring segment being configured to mate with the longitudinal arcuate edge on the next circumferentially adjacent ring segment in abutting relationship to provide a generally mating annular arcuate ring configuration for said plurality of generally longitudinal joints.

2. The tunnel lining according to claim 1 wherein said circumferential edges of said arcuate ring segments are configured so that longitudinally adjacent rings will be in an abutment for only a portion of the annular thickness of said circumferential joints and will be in spaced apart relationship for a portion of the annular thickness of said circumferential joints, said spaced-apart portion defining an annular sealant-receiving groove between longitudinally adjacent rings.

3. The tunnel lining according to claim 2 wherein said annular sealant-receiving grooves are accessible from inside said tunnel lining.

4. The tunnel lining according to claim 1 wherein said generally annular arcuate configuration for said plurality of generally longitudinal joints is provided by generally mating convex and concave surfaces on adjacent longitudinal edges of circumferentially adjacent arcuate ring segments and wherein said mating convex and concave surfaces have approximately equal radii of curvature for only a portion of the annular thickness of said longitudinal joints, whereby adjacent longitudinal edges of circumferentially adjacent arcuate segments are in abutting relationship for only a portion of the annular thickness of said longitudinal joints and are in spaced-apart relationship for another portion of the annular thickness of said longitudinal joints, the said spaced-apart portion defining a sealant- receiving groove between its circumferentially adjacent arcuate ring segments and the abutting concave/convex portions of said longitudinal joints providing a ball-and-socket configuration permitting limited arcuate misalignment between circumferentially adjacent arcuate ring segments.

5. The tunnel lining according to claim 4 wherein said sealant-receiving grooves are accessible from inside said tunnel lining.

6. The tunnel lining according to claim 1 wherein longitudinally adjacent rings of said tunnel lining are held in abutting relationship by means of a plurality of threaded fasteners received through a corresponding number of openings cast in said arcuate ring segments and extending from the inner surface of said ring segments through a stepped portion of the circumferential edges of the segments of one ring and threadedly engaged with thread receiving means in the mating portion of the circumferential edges of longitudinally adjacent segments of the abutting ring.

7. The tunnel lining according to claim 1 wherein circumferentially adjacent arcuate segments of said rings are held in abutting relationship by means of a plurality of threaded fasteners received through a corresponding number of openings cast in said segments and extending from the inner surface of said ring segments through a longitudinal edge of one segment and threadedly engaged with thread receiving means in the mating portion of the longitudinal edge of the circumferentially adjacent ring segment.

8. The tunnel lining according to claim 6 wherein said openings for said threaded fasteners are of tapered configuration, being smallest at the end of said opening extending through said edge and largest at the end of said opening nearest the inner surface of said segment, whereby limited angular misalignment between adjacent rings may be accommodated.

9. The tunnel lining according to claim 6 wherein said thread receiving means comprise plastic threaded inserts cast into said arcuate segments.

10. The tunnel lining according to claim 7 wherein said openings for said threaded fasteners are of tapered configuration, being smallest at the end of said opening extending through said edge and largest at the end of said opening nearest the inner surface of said segment, whereby limited angular misalignment between adjacent ring segments may be accommodated.

11. The tunnel lining according to claim 7 wherein said thread receiving means comprise plastic nuts cast into said arcuate segments.

12. The tunnel lining according to claim 1 wherein each of said arcuate segments has at least one opening extending from the inner to the outer surfaces thereof through which sealant may be pumped to fill an annular cavity between said tunnel lining and the inside surface of a tunnel in which said tunnel lining is placed.

13. The tunnel lining according to claim 1 wherein one of said arcuate segments in each ring comprises a base segment with at least two portions of the inside surface of each base segment being generally flat to provide a continuous generally flat bottom surface for said tunnel lining for accommodating vehicular and pedestrian traffic.

14. The tunnel lining according to claim 13 wherein said base sections include two generally flat surfaces sloping slightly toward a trough portion recessed below the level of said flat surfaces to provide a continuous trough along the bottom of said tunnel lining for drainage.

* * * * *